United States Patent [19]

Barron

[11] Patent Number: 4,683,726

[45] Date of Patent: Aug. 4, 1987

[54] REFRIGERATION APPARATUS

[75] Inventor: Edward J. Barron, Spring, Tex.

[73] Assignee: Rejs Co., Inc., Las Vegas, Nev.

[21] Appl. No.: 886,015

[22] Filed: Jul. 16, 1986

[51] Int. Cl.[4] ..... F25B 43/00

[52] U.S. Cl. ..... 62/503; 62/509; 62/513

[58] Field of Search ..... 62/513, 509, 503

[56] References Cited

U.S. PATENT DOCUMENTS

| | | | |
|---|---|---|---|
| 997,430 | 7/1911 | Whittlesey | 159/4.01 |
| 2,183,346 | 12/1939 | Buchanan | 62/3 |
| 2,489,680 | 11/1949 | Shoemaker et al. | 62/115 |
| 2,518,587 | 8/1950 | Zearfoss | 62/8 |
| 2,885,868 | 5/1959 | Radcliffe | 62/509 |
| 2,897,659 | 8/1959 | Wergner | 62/509 |
| 3,163,998 | 1/1965 | Wile et al. | 62/512 |
| 3,310,103 | 3/1967 | Osborne | 62/512 |
| 3,481,151 | 12/1969 | Seeley | 62/512 |
| 3,553,974 | 1/1971 | Osborne | 62/512 |
| 4,142,381 | 3/1979 | Lavigne, Jr. | 62/510 |
| 4,207,749 | 6/1980 | Lavigne, Jr. | 62/115 |
| 4,259,848 | 4/1981 | Voight | 62/113 |

*Primary Examiner*—Ronald C. Capossela
*Attorney, Agent, or Firm*—Neal J. Mosely

[57] ABSTRACT

A novel approach to refrigeration systems is a final condenser/cooler positioned prior to the metering or expansion device controlling the flow of refrigerant into the evaporator. The final condenser/cooler is positioned in the cold air stream flowing through the evaporator for cooling thereby. The final condenser/cooler expands part of the liquid refrigerant flowing from the condenser to cool the remaining liquid as it flows into the expansion or metering device and into the evaporator. In embodiments where there is no air circulated through the evaporator, a variation of the final condenser/cooler is used where the expanding refrigerant passing from the metering or expansion device to the evaporator passes through a passage in the main chamber of the final condenser/cooler to cool the liquid refrigerant flowing from the receiver.

25 Claims, 10 Drawing Figures

FIG. 1
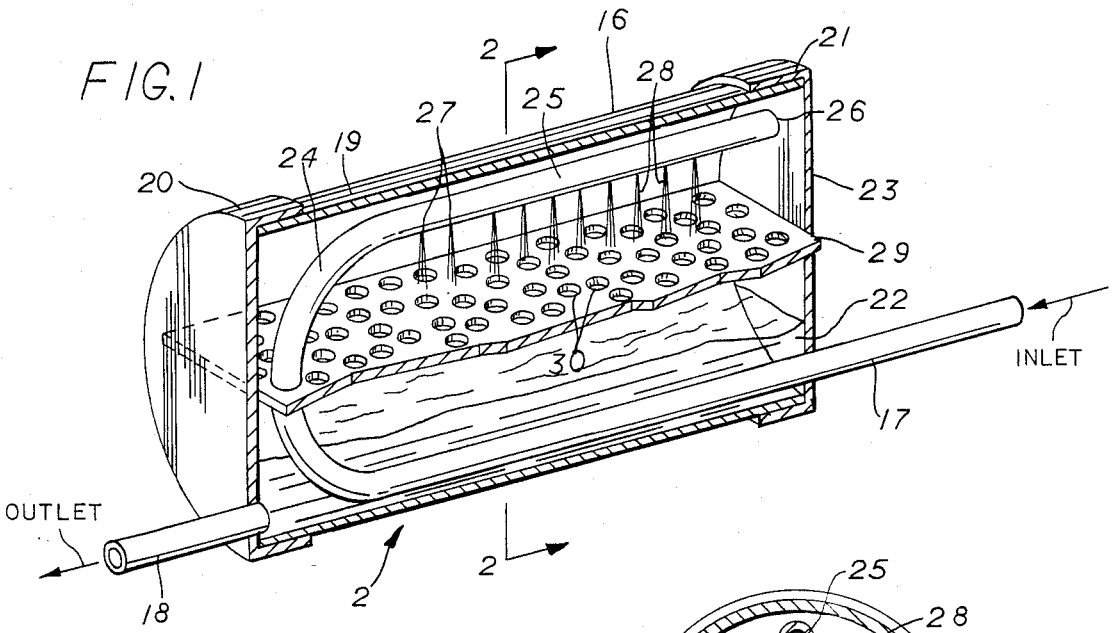
FIG. 2
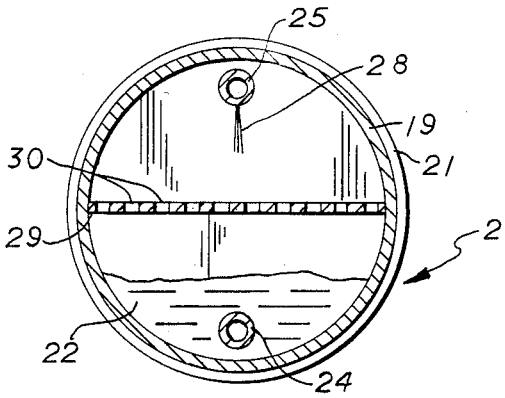
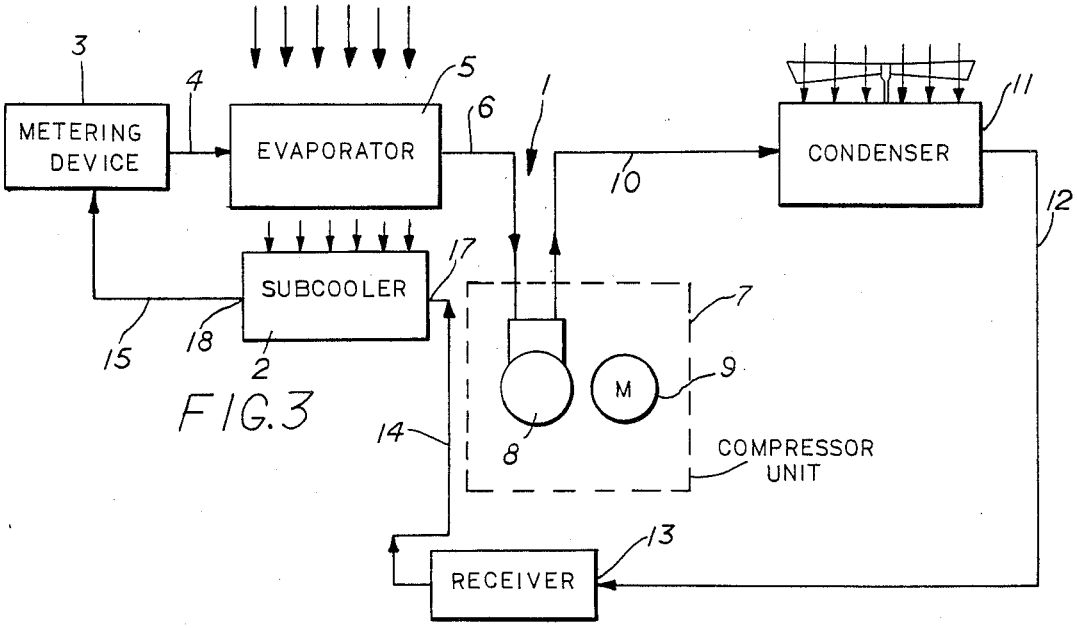
FIG. 3

FIG. 6
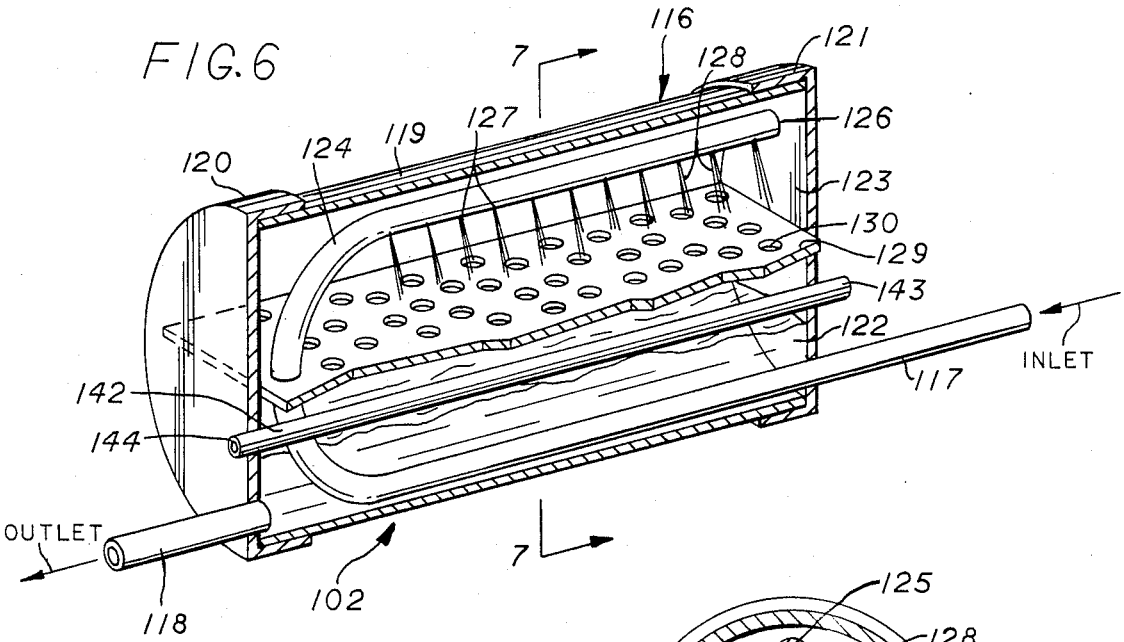
FIG. 7
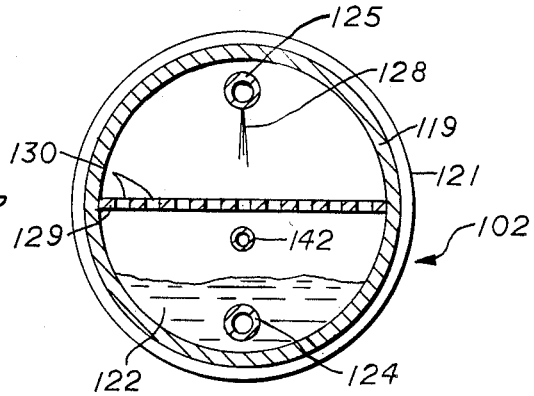
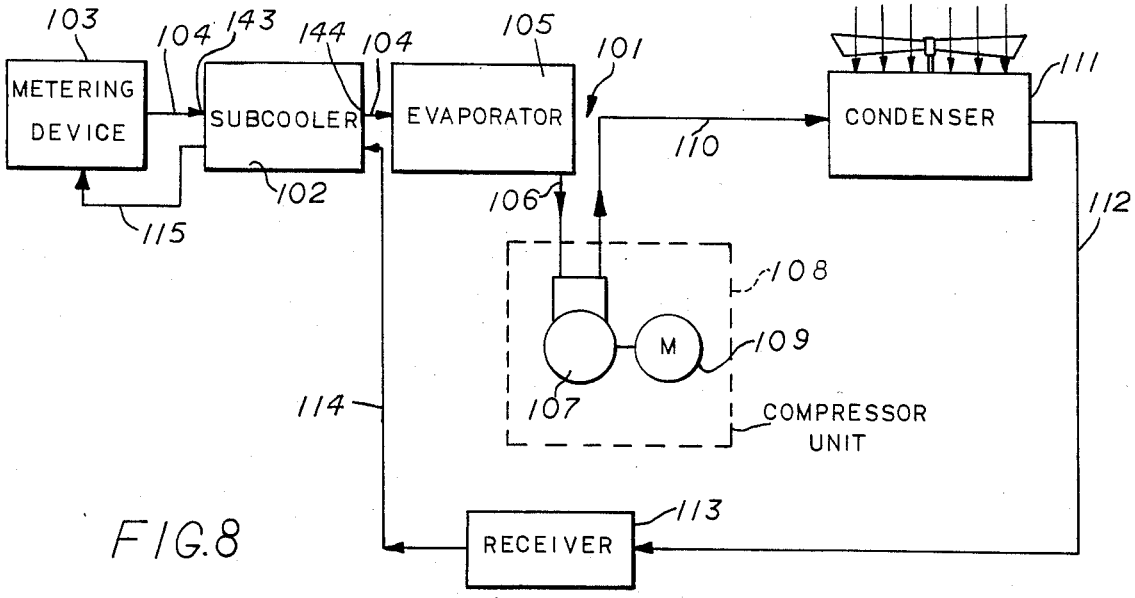
FIG. 8

REFRIGERATION APPARATUS

BACKGROUND OF THE INVENTION

1. Field of the Invention

This invention relates to new and useful improvements in refrigeration systems having a metering device such as an expansion valve, a condenser, a compressor, and an evaporator where means is provided to cool the liquid flowing from the condenser to the metering or expansion device controlling refrigerant flow to the evaporator.

2. Brief Description of the Prior Art

Refrigeration systems consume a significant portion of all electrical energy generated in the United States. Because the systems often have to operate at high ambient temperatures, they seldom operate at the most efficient level. One problem which causes a portion of this inefficiency is the formation of vapor in the liquid refrigerant line between the condenser and the metering device. In many systems, there is a problem of heat absorption in the conduit between the condenser and the metering device.

If the ambient temperature is high vapor may form in the conduit. Additionally, pressure reductions in the line as a result of friction or decreases in the head pressure as the refrigerant moves further from the compressor and condenser can contribute to the formation of vapor. Because the metering or expansion devices generally are sized for passing only liquid, any vapor in the line significantly decreases the efficiency of the system by decreasing the amount of liquid which can pass through the metering device to the evaporator.

Various approaches and procedures have been developed and utilized to overcome the problem of vapor formation. One approach involves increasing the pressure in the liquid refrigerant line to a point that no vapor will form under most or all operating conditions which the system is likely to encounter. However, this requires a larger compressor than would otherwise be necessary, resulting in a greater use of power to run the compressor.

Another approach is disclosed in U.S. Pat. No. 4,259,848 to Voigt. In this system, vapor formed by exposure of the liquid refrigerant conduit to ambient conditions is withdrawn from a receiver by a dual suction compressor, and the refrigerant approaching the expansion valve is adiabatically cooled to liquefy vapor formed by withdrawal of vaporized refrigerant from the high pressure portion of the circuit. This system has several drawbacks. It cannot be used effectively on refrigeration systems having a hot gas defrost; a complicated valving between the receiver and the compressor is required to control the flow of vaporized refrigerant from the high pressure line back to the compressor; and the metering device must be an expansion valve.

Accordingly, it would be a significant advancement in the art to have a fixed, mechanical condensing final condenser/cooler which could be used in closed circuit refrigeration systems to cool the liquid refrigerant before passing through the metering or expansion device. It would be particularly advantageous to provide such a system which is simple in construction and operation, and which is effective. Such a system is disclosed and claimed herein.

SUMMARY OF THE INVENTION

One of the objects of this invention is to provide an improved refrigeration system with means for cooling the hot liquefied refrigerant prior to its passing through the metering or expansion device into the evaporator.

Another object of this invention is to provide an improved refrigeration system with a final condenser/-cooler having means to expand part of the hot liquefied refrigerant for cooling the same prior to its passing through the metering or expansion device into the evaporator.

Another object of this invention is to provide an improved refrigeration system with a final condenser/-cooler having means to expand part of the hot liquefied refrigerant for cooling the same prior to its passing through the metering or expansion device into the evaporator and being positioned in the cold air stream flowing from the evaporator.

Still another object of this invention is to provide an improved refrigeration system with a final condenser/-cooler having means to expand part of the hot liquefied refrigerant for cooling the same prior to its passing through the metering or expansion device into the evaporator, wherein the final condenser/cooler has a passage through which cold refrigerant flows from the metering or expansion device into the evaporator.

Other objects of this invention will become apparent from time to time throughout the specification and claims as hereinafter related.

These objects and other objects of the invention are accomplished by a novel refrigeration system having a final condenser/cooler positioned between the liquid receiver and the metering or expansion device controlling the flow of refrigerant into the evaporator. The final condenser/cooler is positioned in the cold air stream flowing through the evaporator for cooling thereby. The final condenser/cooler expands part of the liquid refrigerant flowing from the condenser to cool the remaining liquid as it flows into the expansion or metering device and into the evaporator. In embodiments where there is no air circulated through the evaporator, a variation of the final condenser/cooler is used where the expanding refrigerant passing from the metering or expansion device to the evaporator passes through a passage in the main chamber of the final condenser/cooler to cool the liquid refrigerant flowing from the receiver.

BRIEF DESCRIPTION OF THE DRAWINGS

FIG. 1 is a view in cross sectio of one preferred embodiment of a final condenser/cooler used in the present invention mounted in a horizontal position.

FIG. 2 is a cross-section taken along the line 2—2 of FIG. 1.

FIG. 3 is a schematic view of a refrigeration circuit with the final condenser/cooler of FIGS. 1, 4 or 5 connected therein.

FIG. 6 is a view in cross section of another preferred embodiment of a final condenser/cooler used in the present invention mounted in a horizontal position and having a connection for passing expanded refrigerant from the metering or expansion device therethrough for added cooling.

FIG. 7 is a cross-section taken along the line 7—7 of FIG. 1.

FIG. 8 is a schematic view of a refrigeration circuit with the final condenser/cooler of FIGS. 7, 9 or 10 connected therein.

DESCRIPTION OF A PREFERRED EMBODIMENT

Figure 4:
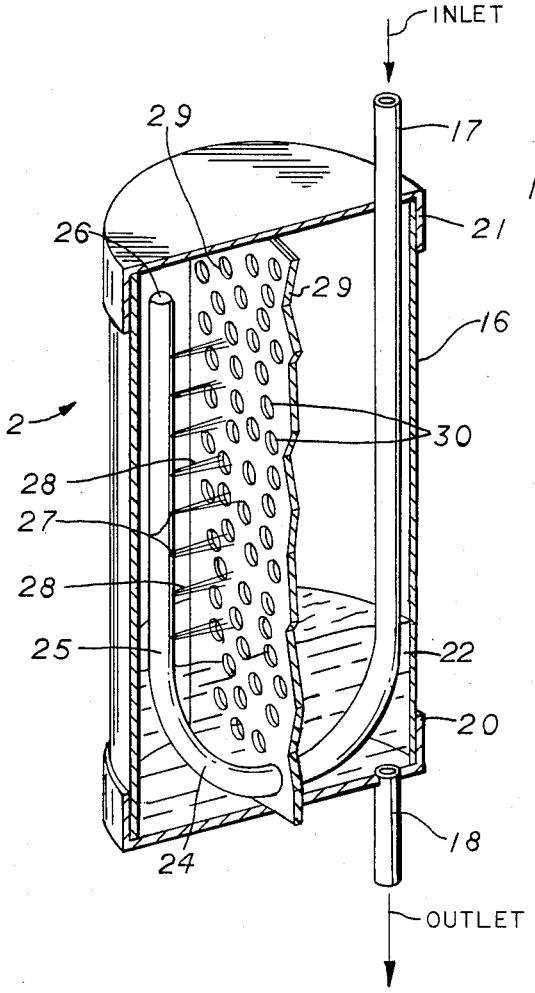
FIG. 4 illustrates the embodiment shown in FIG. 1 mounted in a vertical position.

This invention has a fixed final condenser/cooler for cooling refrigerant liquid prior to its entering a metering or expansion device such as an expansion valve or capillary tube in a closed-circuit refrigeration system. The final condenser/cooler comprises a shell forming a chamber having an inlet and an outlet and is placed in the liquid refrigeration line immediately preceding the metering device in the direction of flow.

In a preferred embodiment, the pressure reducing means comprises a length of tubing attached to the inlet to the shell, said tubing including a plurality of orifices through which refrigerant is discharged into the chamber in the shell. A liquid level is maintained within the sub-cooler and the outlet is connected below the level of the liquid such that vapor is not passed through the outlet to the metering device. The final condenser/-cooler is positioned in the cold air stream from the evaporator to assist in removing heat from the shell of the cooler.

Referring to the drawings by numerals of reference, and first to FIG. 3, there is shown a schematic view of a conventional refrigeration system, generally designated 1, into which a final condenser/cooler 2 has been incorporated.

Refrigeration system 1 includes a metering or expansion device 3, such as an expansion valve, capillary tube, or the like as used in refrigeration circuits. A low pressure liquid line 4 extends from metering device 3 to evaporator 5 where the refrigerant is vaporized to absorb heat. From the evaporator, the vaporized refrigerant passes through line 6 to compressor 7. Compressor unit 7 comprises a compressor 8 driven by a motor 9. Any conventional compressor unit can be utilized in circuits incorporating the present invention.

From compressor 8, high pressure refrigerant gas passes through line 10 to condenser 11 where the refrigerant is condensed. In this embodiment, condenser 11 is an air cooled condenser, but the system can also utilize water cooled units or any other type of conventioal condenser.

The liquefied refrigerant passes through line 12 to receiver 13. Sometimes, when utilizing the present invention it is possible to eliminate receiver 13 from the refrigeration system. Liquefied refrigerant passes through line 14 to final condenser/cooler 2 where it is cooled before the refrigerant passes through line 15 to metering device 3. Final condenser/cooler 2 is positioned in the cold air flowing from the evaporator 5.

In FIG. 1, a preferred embodiment of final condenser/cooler 2 is illustrated in cross-section. Sub-cooler 2 has a shell 16 with an inlet 17 connected to line 14 from the receiver 13 or condenser 11 (in cases where the receiver is eliminated) and an outlet 18 connected to the line 15 to the metering device. In this embodiment, shell 16 comprises a cylindrical tube 19 with end caps 20 and 21. Shell 16 defines a chamber which is partially filled with liquid refrigerant such that there is a liquid level 22 and vapor space 23.

In this embodiment, a portion 24 of line 14 extends into shell 16 and is bent into a U-shaped configuration to form a spray bar 25 which is positioned in vapor space 23. The end of spray bar 25 includes a cap or plug 26. Orifices 27 are formed along a portion of the length of spray bar 25 to act as nozzles. Liquid refrigerant 28 sprays out of orifices 27 and is partially evaporated to produce a cooling effect.

Liquid refrigerant 22 in the bottom of final condenser/cooler 2 is withdrawn through outlet 18 into line 15 to the metering device. If final condenser/cooler 2 is properly sized, receiver 13 (in FIG. 3) can be eliminated from the refrigeration circuit and the chamber formed by shell 16 of final condenser/cooler 2 can serve as the receiver.

In this embodiment, a plate 29 is positioned within shell 16 between spray bar 25 and the liquid 22. Plate 29 has a plurality of orifices 30 through which the liquid refrigerant can pass. Plate 29 prevents splashing of the liquid 22 which might be caused by the spray 28. However, plate 29 is not essential to the operation of final condenser/cooler 12 and can be eliminated if desired.

The number and size of the orifices 27 in spray bar 25 are adjusted to produce a pressure drop of from about 3 to about 6 p.s.i. across final condenser/cooler 2. The preferred pressure drop is about 5 pounds p.s.i. when using a refrigerant such as F-11, F12, F22, F500, or F502. The cold air from evaporator 5 cools the shell 16 and assists in condensing any vapor formed in the liquid line.

The cooling by cold air from evaporator 5 and by evaporation of refrigerant spray 28 reduces the temperature of the hot refrigerant liquid and makes it possible to reduce the refrigerant charge and thus the operating pressure and temperature of the refrigeration system. This allows a given volume of refrigerant to have a greater cooling effect as it passes through the evaporator downstream from the metering device. Accordingly, the refrigeration system is more efficient and less power is required to provide the same cooling effect.

ANOTHER EMBODIMENT

In FIG. 4, the embodiment of FIGS. 1 and 2 is shown as it would operate if installed in vertical position. The inlet 17 is arranged to enter the top of shell 16 and outlet 18 is positioned in the bottom. The level of the liquid 22 is generally adjusted such that it is below the orifices 27. Should the liquid level rise so as to cover the bottom most of orifices 27, the final condenser/cooler will still operate but its cooling capacity will be reduced.

ANOTHER EMBODIMENT

Figure 5:
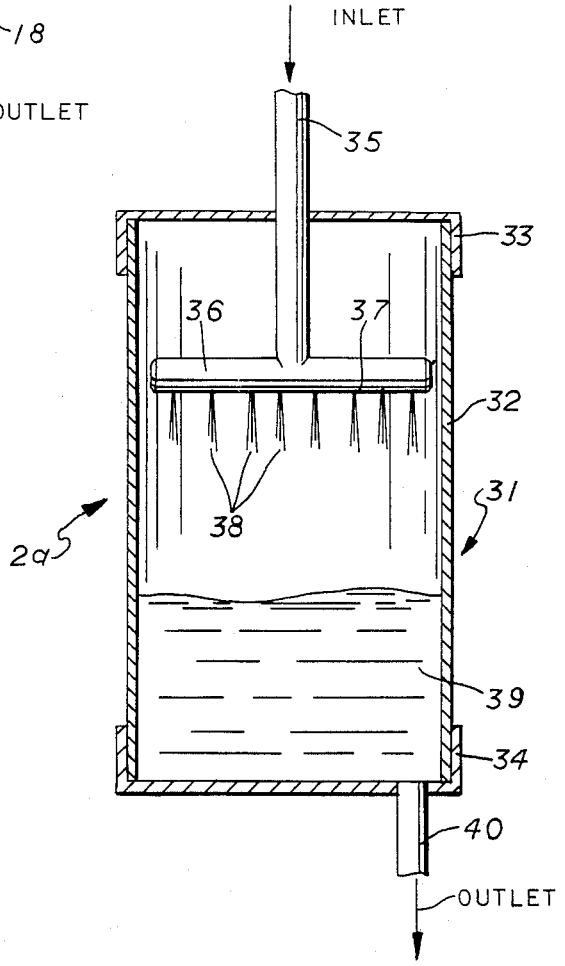
FIG. 5 is a cross-section of a second preferred embodiment of a final condenser/cooler used in the present invention.

Referring now to FIG. 5, a further embodiment of the final condenser/cooler used in this invention is shown in cross section. Sub-cooler 2*a* includes a shell 31 which is a piece of cylindrical tubing 32 with end caps 33 and 34. Inlet 35 passes through upper end cap 33 and is connected to spray bar 36 by a T-connection. Spray bar 36 includes a plurality of orifices 37 through which liquid refrigerant 38 is sprayed. Liquid refrigerant 39 is maintained at a level in the bottom of shell 31 and is removed through outlet 40.

While the invention has been described with respect to the presently preferred embodiments, it will be appreciated that other modifications or changes could be made without departing from its scope or essential characteristics. For example, in FIG. 5 a plurality of spray bars could be used or the spray bar could be configured as a disk with a plurality of orifices. Changes could also be made to the shape of the shell of the final condenser/cooler. Additionally, the system can be operated with or without a plate between the spray bar and the surface of the liquid refrigerant.

DIRECT EXPANSION COOLING OF SUBCOOLER

In the embodiments of FIGS. 6–10, the invention has a fixed final condenser/cooler for cooling refrigerant liquid prior to its entering a metering or expansion device such as an expansion valve or capillary tube in a closed-circuit refrigeration system. The final condenser/cooler comprises a shell forming a chamber having an inlet and an outlet and is placed in the liquid refrigeration line immediately preceding the metering device in the direction of flow. The final condenser/cooler is connected to receive refrigerant from the metering or expansion device to provide supplemental cooling for systems where there is no air circulation through the evaporator to use for cooling the final condenser/-cooler.

In a preferred embodiment, the pressure reducing means comprises a length of tubing attached to the inlet to the shell, said tubing including a plurality of orifices through which refrigerant is discharged into the chamber in the shell. A liquid level is maintained within the final condenser/cooler and the outlet is connected below the level of the liquid such that vapor is not passed through the outlet to the metering device. The final condenser/cooler has a heat exchange tube receiving cold refrigerant from the expansion device to assist in removing heat from the shell of the cooler.

Referring to the drawings by numerals of reference, and more particularly to FIG. 8, there is shown a schematic view of a conventional refrigeration system, generally designated 101, into which a final condenser/-cooler 102 has been incorporated.

Refrigeration system 101 includes a metering or expansion device 103, such as an expansion valve, capillary tube, or the like as used in refrigeration circuits. A low pressure liquid line 104 extends from metering device 103 and through the shell of final condenser/cooler 102 to evaporator 105 where the refrigerant is vaporized to absorb heat. From the evaporator 105, the vaporized refrigerant passes through line 106 to compressor 107. Compressor unit 108 comprises compressor 107 driven by a motor 109. Any conventional compressor unit can be utilized in circuits incorporating the present invention.

From compressor 107, high pressure refrigerant gas passes through line 110 to condenser 111 where the refrigerant is condensed. In this embodiment, condenser 111 is an air cooled condenser, but the system can also utilize water cooled units or any other type of conventional condenser.

The liquefied refrigerant passes through line 112 to receiver 113. Sometimes, when utilizing the present invention it is possible to eliminate receiver 113 from the refrigeration system. Liquefied refrigerant passes through line 114 to final condenser/cooler 102 where it is cooled before the refrigerant passes through line 115 to metering device 103. Sub-cooler 102 is connected to receive cold refrigerant flowing from metering or expansion device 103 to evaporator 105.

In FIG. 6, another preferred embodiment of final condenser/cooler 102 is illustrated in cross-section. Final condenser/cooler 102 has a shell 116 with an inlet 117 connected to line 114 from the receiver 113 or condenser 111 (in cases where the receiver is eliminated) and an outlet 118 connected to the line 115 to the metering device. In this embodiment, shell 116 comprises a cylindrical tube 119 with end caps 120 and 121. Shell 116 defines a chamber which is partially filled with liquid refrigerant such that there is a liquid level 122 and a vapor space 123.

In this embodiment, a portion 124 of line 114 extends into shell 116 and is bent into a U-shaped configuration to form a spray bar 125 which is positioned in vapor space 123. The end of spray bar 125 includes a cap or plug 126. Orifices 127 are formed along a portion of the length of spray bar 125 to act as nozzles. Liquid refrigerant 128 sprays out of orifices 127 and is partially evaporated to produce a cooling effect.

A heat exchange tube or conduit 142 extends through the chamber enclosed by shell 116 and out through end caps 120 and 121. Heat exchange tube 142 has an inlet 143 connected to and a part of tube or conduit 104 leading from expansion device 103 and an outlet 144 connected to that portion of conduit leading to the evaporator 105. The expanding refrigerant from expansion device 103 cools the hot liquid refrigerant 122 and assists in cooling the final condenser/cooler to permit expansion of refrigerant 128 sprayed from orifices 127.

Liquid refrigerant 122 in the bottom of final condenser/cooler 102 is withdrawn through outlet 118 into line 115 to the metering device. If final condenser/cooler 102 is properly sized, receiver 113 (in FIG. 8) can be eliminated from the refrigeration circuit and the chamber formed by shell 116 of final condenser/cooler 102 can serve as the receiver.

In this embodiment, a plate 129 is positioned within shell 116 between spray bar 125 and the liquid 122. Plate 129 has a plurality of orifices 130 through which the liquid refrigerant can pass. Plate 129 prevents splashing of the liquid 122 which might be caused by the spray 128. However, plate 129 is not essential to the operation of final condenser/cooler 112 and can be eliminated if desired.

The number and size of the orifices 127 in spray bar 125 are adjusted to produce a pressure drop of from about 3 to about 6 p.s.i. across final condenser/cooler 102. The preferred pressure drop is about 5 pounds p.s.i. when using a refrigerant such as F-11, F12, F22, F500, or F502.

The cooling by cold vaporizing refrigerant flowing through the tube 142 from metering or expansion device 103 and by evaporation of refrigerant spray 128 reduces the temperature of the hot refrigerant liquid and makes it possible to reduce the refrigerant charge and thus the operating pressure and temperature of the refrigeration system. This allows a given volume of refrigerant to have a greater cooling effect as it passes through the evaporator downstream from the metering device. Accordingly, the refrigeration system is more efficient and less power is required to provide the same cooling effect.

ANOTHER EMBODIMENT OF DIRECT EXPANSION COOLER

Figure 9:
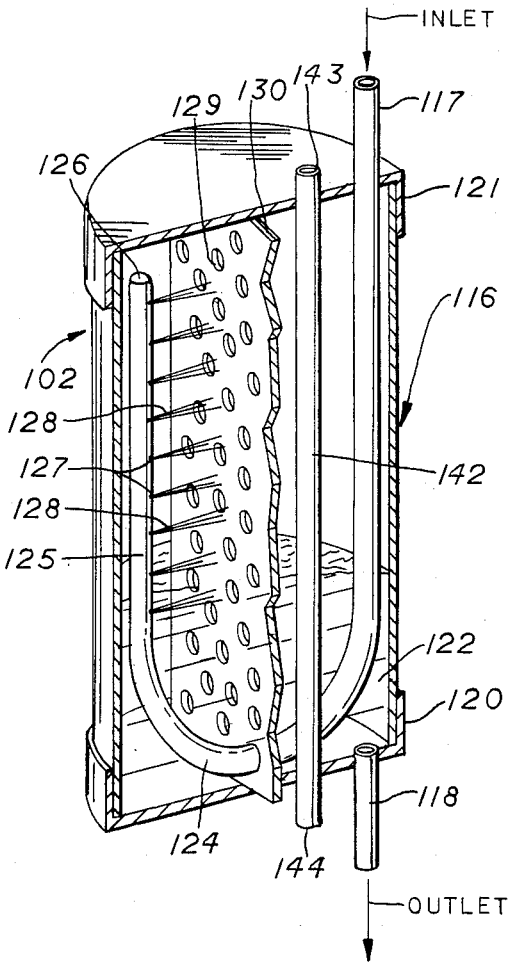
FIG. 9 illustrates the embodiment shown in FIG. 6 mounted in a vertical position.

In FIG. 9, the embodiment of FIGS. 6 and 7 is shown as it would operate if installed in vertical position. The inlet 117 is arranged to enter the top of shell 116 and outlet 118 is positioned in the bottom. The level of the liquid 122 is generally adjusted such that it is below the orifices 127. Should the liquid level rise so as to cover the bottom most of orifices 127, the final condenser/-cooler will still operate but its cooling capacity will be reduced.

A heat exchange tube or conduit 142 extends through the chamber enclosed by shell 116 and out through end caps 120 and 121. Heat exchange tube 142 has an inlet 143 connected to and a part of tube or conduit 104 leading from expansion device 103 and an outlet 144 connected to that portion of conduit leading to evaporator 105. Expanding refrigerant from expansion device 103 cools the hot liquid refrigerant 122 and assists in cooling the final condenser/cooler to permit expansion of refrigerant 128 sprayed from orifices 127.

STILL ANOTHER EMBODIMENT OF DIRECT EXPANSION COOLER

Figure 10:
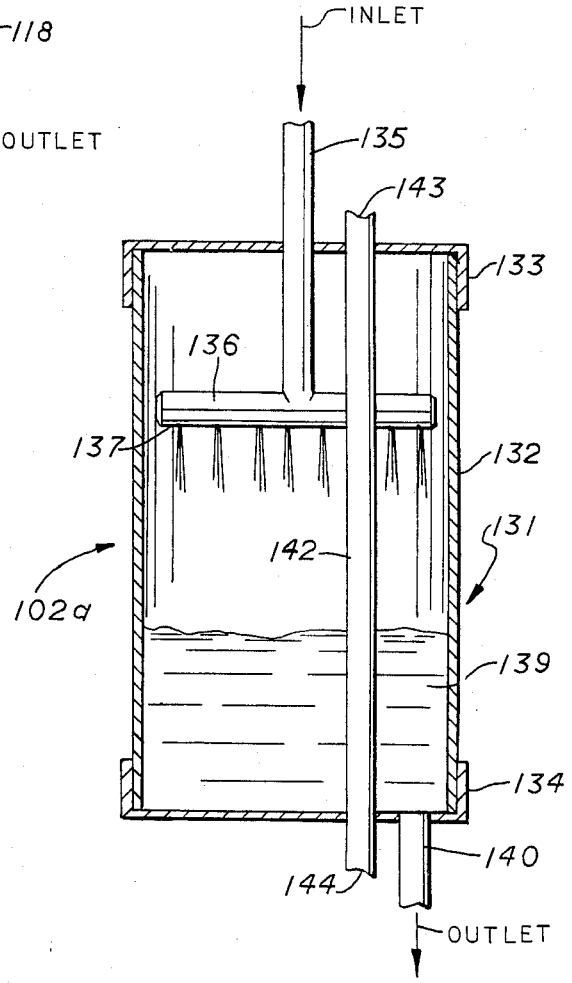
FIG. 10 is a view in cross section of still another preferred embodiment of a final condenser/cooler used in the present invention having a connection for passing expanded refrigerant from the metering or expansion device therethrough for added cooling.

Referring now to FIG. 10, a further embodiment of the final condenser/cooler used in this invention is shown in cross section. Sub-cooler 102*a* includes a shell 131 which is a piece of cylindrical tubing 132 with end caps 133 and 134. Inlet 135 passes through upper end cap 133 and is connected to spray bar 136 by a T-connection. Spray bar 136 includes a plurality of orifices 137 through which liquid refrigerant 138 is sprayed. Liquid refrigerant 139 is maintained at a level in the bottom of shell 131 and is removed through outlet 140.

A heat exchange tube or conduit 142 extends through the chamber enclosed by shell 116 and out through end caps 120 and 121. Heat exchange tube 142 has an inlet 143 connected to and a part of tube or conduit 104 leading from expansion device 103 and an outlet 144 connected to that portion of conduit leading to evaporator 105. Expanding refrigerant from expansion device 103 cools the hot liquid refrigerant 122 and assists in cooling the final condenser/cooler to permit expansion of refrigerant 128 sprayed from orifices 127.

While the invention has been described fully and completely with respect to several preferred embodiments thereof, it should be understood that within the scope of the appended claims this invention may be practiced otherwise than as specifically described therein.

I claim:

1. A refrigeration system comprising a compressor, a condenser, a refrigeration metering or expansion device, and an evaporator connected in series with the outlet of the compressor being connected to the inlet to the condenser to conduct compressed refrigerant gas thereto, the outlet of the condenser connected to the inlet of the evaporator to conduct liquid refrigerant thereto, and the outlet of the evaporator connected to the inlet to the compressor to conduct vaporized refrigerant thereto, said system including means circulating air over said evaporator to provide cold air to a selected space, further including a refrigerant final condenser/cooler connected between the outlet from said condenser and the inlet to said metering or expansion device and positioned adjacent to said evaporator whereby the flow of cold air from said evaporator over said final condenser/cooler pre-cools the hot gas refrigerant flowing therebetween by vaporization of part of the liquid refrigerant flowing therethrough, said final condenser/cooler comprising a hollow housing defining a closed chamber, a conduit extending into said chamber having an inlet connected to receive liquid refrigerant flowing from said condenser and a free end terminating in said chamber having an end closure and a plurality of orifices for spraying liquid refrigerant therethrough, said sprayed liquid refrigerant collecting in the bottom of said chamber, and said housing having an outlet below the level of liquid in said chamber and connected to said metering or expansion device, whereby the flow of cold air over said housing and expansion of said sprayed liquid refrigerant are operable to cool the liquid refrigerant is said housing and flowing to said metering or expansion device.

2. A refrigeration system according to claim 1 in which said housing is oriented with the inlet at the top and outlet at the bottom end thereof with said liquid refrigerant collecting over said bottom outlet end, and said conduit is formed into a U-shape inside said housing and said orifices are positioned above the liquid level in said chamber and directed parallel to the liquid surface.

3. A refrigeration system according to claim 2 in which said housing further includes a perforated plate positioned above the liquid level and between said orifices and the unperforated main portion of said conduit.

4. A refrigeration system according to claim 1 in which said conduit has a portion extending parallel to the surface of said liquid and has a portion comprising a manifold with orifices therein directed toward said liquid surface, and a main portion of said conduit extending from said inlet to a mid point of said manifold.

5. A refrigeration system according to claim 1 in which said housing is oriented with the inlet at the top and outlet at the bottom end thereof with said liquid refrigerant collecting over said bottom outlet end, said conduit has a portion extending parallel to the surface of said liquid and has a portion comprising a manifold with orifices therein directed toward said liquid surface, and a main portion of said conduit extending from said inlet to a mid point of said manifold.

6. A refrigeration system according to claim 5 in which said manifold comprises a tee shaped conduit with the stem portion extending to said inlet and the cross portion having orifices directed toward said liquid surface.

7. A refrigeration system comprising a compressor, a condenser, a refrigeration metering or expansion device, and an evaporator connected in series with the outlet of the compressor being connected to the inlet to the condenser to conduct compressed refrigerant gas thereto, the outlet of the condenser connected to the inlet of the evaporator to conduct liquid refrigerant thereto, and the outlet of the evaporator connected to the inlet to the compressor to conduct vaporized refrigerant thereto, said system including means circulating air over said evaporator to provide cold air to a selected space, further including a refrigerant final condenser/cooler positioned between the outlet from said condenser and the inlet to said metering or expansion device and in the flow of cold air from said evaporator to pre-cool the hot gas refrigerant flowing therebetween by vaporization of part of the liquid refrigerant flowing from said condenser to said evaporator, said final condenser/cooler comprising a hollow housing defining a closed chamber, a conduit extending into said chamber having an inlet connected to receive liquid refrigerant flowing from said condenser and a free end terminating in said chamber having an end closure and a plurality of orifices for spraying liquid refrigerant therethrough, said sprayed liquid refrigerant collecting in the bottom of said chamber, said conduit being formed into a U-shape inside said housing and said orifices are positioned above the liquid level in said chamber and directed toward the liquid surface, and said housing having an outlet below the level of liquid in said chamber and connected to said metering or expansion device, whereby the flow of cold air over said housing and expansion of said sprayed liquid refrigerant are operable to cool the liquid refrigerant is said housing and flowing to said metering or expansion device.

8. A refrigeration system according to claim 7 in which said housing further includes a perforated plate positioned above the liquid level and below said orifices.

9. A refrigeration system comprising a compressor, a condenser, a refrigeration metering or expansion device, and an evaporator connected in series with the outlet of the compressor being connected to the inlet to the condenser to conduct compressed refrigerant gas thereto, the outlet of the condenser connected to the inlet of the evaporator to conduct liquid refrigerant thereto, and the outlet of the evaporator connected to the inlet to the compressor to conduct vaporized refrigerant thereto, said system including means circulating air over said evaporator to provide cold air to a selected space, further including a refrigerant final condenser/cooler positioned between the outlet from said condenser and the inlet to said metering or expansion device and in the flow of cold air from said evaporator to pre-cool the hot gas refrigerant flowing therebetween by vaporization of part of the liquid refrigerant flowing from said condenser to said evaporator, said final condenser/cooler comprising a hollow housing defining a closed chamber, said housing comprising a tubular shell with end closure members, a conduit extending into said chamber having an inlet connected to receive liquid refrigerant flowing from said condenser and a free end terminating in said chamber having an end closure and a plurality of orifices for spraying liquid refrigerant therethrough, said sprayed liquid refrigerant collecting in the bottom of said chamber, said conduit extending through one of said end closures and being formed into a U-shape inside said housing, said orifices are positioned above the liquid level in said chamber and directed toward the liquid surface, and said housing having an outlet below the level of liquid in said chamber and connected to said metering or expansion device, whereby the flow of cold air over said housing and expansion of said sprayed liquid refrigerant are operable to cool the liquid refrigerant is said housing and flowing to said metering or expansion device.

10. A refrigeration system comprising a compressor, a condenser, a refrigeration metering or expansion device, and an evaporator connected in series with the outlet of the compressor being connected to the inlet to the condenser to conduct compressed refrigerant gas thereto, the outlet of the condenser connected to the inlet of the evaporator to conduct liquid refrigerant thereto, and the outlet of the evaporator connected to the inlet to the compressor to conduct vaporized refrigerant thereto, further including a refrigerant final condenser/cooler positioned between the outlet from said condenser and the inlet to said metering or expansion device and in the flow of cold air from said evaporator to pre-cool the hot gas refrigerant flowing therebetween by vaporization of part of the liquid refrigerant flowing from said condenser to said evaporator, said final condenser/cooler comprising a hollow housing defining a closed chamber, a first conduit extending into said chamber having an inlet connected to receive liquid refrigerant flowing from said condenser and a free end terminating in said chamber having an end closure and a plurality of orifices for spraying liquid refrigerant therethrough, said sprayed liquid refrigerant collecting in the bottom of said chamber, a second conduit extending through said chamber having an inlet connected to receive expanding refrigerant flowing from said metering or expansion device and an outlet end connected to the inlet end of said evaporator, and said housing having an outlet below the level of liquid in said chamber and connected to said metering or expansion device, whereby the expansion of said sprayed liquid refrigerant from said first conduit and said expanding refrigerant flowing through said second conduit are operable to cool the liquid refrigerant in said housing and flowing to said metering or expansion device.

11. A refrigeration system according to claim 10 in which said first conduit is formed into a U-shaped inside said housing and said orifices are positioned above the liquid level in said chamber and directed toward the liquid surface.

12. A refrigeration system according to claim 11 in which said housing further includes a perforated plate positioned above the liquid level and below said orifices.

13. A refrigeration system according to claim 10 in which said housing is oriented with the inlet at the top and outlet at the bottom end thereof with said liquid refrigerant collecting over said bottom outlet end, and said first conduit is formed into a U-shape inside said housing and said orifices are positioned above the liquid level in said chamber and directed parallel to the liquid surface.

14. A refrigeration system according to claim 13 in which said housing further includes a perforated plate positioned above the liquid level and between said orifices and the unperforated main portion of said first conduit.

15. A refrigeration system according to claim 10 in which said first conduit has a portion extending parallel to the surface of said liquid and has a portion comprising a manifold with orifices therein directed toward said liquid surface, and a main portion of said conduit extending from said inlet to a mid point of said manifold.

16. A refrigeration system according to claim 10 in which said housing is oriented with the inlet at the top and outlet at the bottom end thereof with said liquid refrigerant collecting over said bottom outlet end, said first conduit has a portion extending parallel to the surface of said liquid and has a portion comprising a manifold with orifices therein directed toward said liquid surface, and a main portion of said first conduit extending from said inlet to a mid point of said manifold.

17. A refrigeration system according to claim 16 in which said manifold comprises a tee shaped conduit with the stem portion extending to said inlet and the cross portion having orifices directed toward said liquid surface.

18. A refrigeration system according to claim 10 in which said housing comprises a tubular shell with end closure members, said first conduit extends through one of said end closures and is formed into a U-shape inside said housing, said orifices are positioned above the liquid level in said chamber and directed toward the liquid surface, and said second conduit extends through said end closures and from end to end through said housing.

19. A final condenser/cooler for use in a refrigeration system comprising a compressor, a condenser, a refrigeration metering or expansion device, and an evaporator connected in series with the outlet of the compressor being connected to the inlet to the condenser to conduct compressed refrigerant gas thereto, the outlet of the condenser connected to the inlet of the evaporator to conduct liquid refrigerant thereto, and the outlet of the evaporator connected to the inlet to the compressor to conduct vaporized refrigerant thereto, said refrigerant final condenser/cooler being adapted to be positioned between the outlet from said condenser and the inlet to said metering or expansion device and in the flow of cold air from said evaporator to pre-cool the hot gas refrigerant flowing therebetween by vaporization of part of the liquid refrigerant flowing from said condenser to said evaporator, said final condenser/cooler comprising a hollow housing defining a closed chamber, a first conduit extending into said chamber having an inlet adapted to be connected to receive liquid refrigerant flowing from said condenser and a free end terminating in said chamber having an end closure and a plurality of orifices for spraying liquid refrigerant therethrough, said sprayed liquid refrigerant collecting in the bottom of said chamber, a second conduit extending through said chamber having an inlet adapted to be connected to receive expanding refrigerant flowing from said metering or expansion device and an outlet end connected to the inlet end of said evaporator, and said housing having an outlet below the level of liquid in said chamber and adapted to be connected to said metering or expansion device, whereby the expansion of said sprayed liquid refrigerant from said first conduit and said expanding refrigerant flowing through said second conduit are operable to cool the liquid refrigerant in said housing and flowing to said metering or expansion device.

20. A final condenser/cooler according to claim 19 in which said first conduit is formed into a U-shape inside said housing and said orifices are positioned above the liquid level in said chamber and directed toward the liquid surface.

21. A final condenser/cooler according to claim 20 in which said housing further includes a perforated plate positioned above the liquid level and below said orifices.

22. A final condenser/cooler according to claim 19 in which said first conduit has a portion extending parallel to the surface of said liquid when installed horizontally and has a portion comprising a manifold with orifices therein directed toward said liquid surface, and the main portion of said conduit extending from said inlet to a mid point of said manifold.

23. A final condenser/cooler according to claim 19 in which said housing is oriented when installed with the inlet at the top and outlet at the bottom end with said liquid refrigerant collecting over said bottom outlet end, said first conduit has a portion extending parallel to the surface of said liquid and has a portion comprising a manifold with orifices therein directed toward said liquid surface, and the main portion of said first conduit extending from said inlet to a mid point of said manifold.

24. A final condenser/cooler according to claim 23 in which said manifold comprises a tee shaped conduit with the stem portion extending to said inlet and the cross portion having orifices directed toward said liquid surface.

25. A final condenser/cooler according to claim 19 in which said housing comprises a tubular shell with end closure members, said first conduit extends through one of said end closures and is formed into a U-shape inside said housing, said orifices are positioned above the liquid level in said chamber and directed toward the liquid surface, and said second conduit extends through said end closures and from end to end through said housing.

* * * * *